US007344408B2

(12) United States Patent
Kato et al.

(10) Patent No.: US 7,344,408 B2
(45) Date of Patent: Mar. 18, 2008

(54) WATERPROOF PACKING, WATERPROOF CONNECTOR USING THE SAME AND PROCESS FOR PRODUCING WATERPROOF CONNECTOR

(75) Inventors: Tetsuo Kato, Shizuoka (JP); Kazuki Zaitsu, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/399,475

(22) Filed: Apr. 7, 2006

(65) Prior Publication Data

US 2006/0240710 A1 Oct. 26, 2006

(30) Foreign Application Priority Data

Apr. 25, 2005 (JP) ..... 2005-127198

(51) Int. Cl.
*H01R 9/05* (2006.01)

(52) U.S. Cl. ..... 439/578

(58) Field of Classification Search ..... 439/578, 439/936, 589, 274, 275; 174/76, 93

See application file for complete search history.

(56) References Cited

U.S. PATENT DOCUMENTS 4,335,932 A * 6/1982 Herrmann, Jr. ..... 439/587
4,851,972 A * 7/1989 Altman ..... 362/267
6,142,825 A * 11/2000 Shinchi ..... 439/587

FOREIGN PATENT DOCUMENTS

JP 10-321287 12/1998
JP 2001-351724 12/2001
JP 2005-5269 1/2005

* cited by examiner

*Primary Examiner*—Phuong Dinh
(74) *Attorney, Agent, or Firm*—Kratz, Quintos & Hanson, LLP

(57) ABSTRACT

A waterproof packing includes: a core member including an electric wire passing part inside and a contacting part for fitting to a mounting side outside; and thermoplastic adhesive adhering to at least the electric wire passing part and the contacting part, wherein the waterproof packing adheres to an electric wire with the thermoplastic adhesive of the electric wire passing part and the waterproof packing adheres to the mounting side with the thermoplastic adhesive of the contacting part by heating. A waterproof connector includes: the waterproof packing; a connector housing for inserting an electric wire having a terminal therein; and a packing receiving part of the connector housing, wherein the waterproof packing is inserted in the packing receiving part as the mounting side.

8 Claims, 9 Drawing Sheets

WATERPROOF PACKING, WATERPROOF CONNECTOR USING THE SAME AND PROCESS FOR PRODUCING WATERPROOF CONNECTOR

BACKGROUND OF THE INVENTION (1) Field of the Invention

The present invention relates to a waterproof packing which adheres to an outer peripheral surface of an electric wire and an inner peripheral surface of a packing-mounting side with a thermoplastic adhesive so as to achieve secure waterproofing, a waterproof connector using such a waterproof packing, and a process for producing such a waterproof connector.

(2) Description of the Related Art

FIG. 16 shows an example of a conventional waterproof connector and a process for producing the conventional waterproof connector (see Japanese Patent Application Laid-Open No. H10-321287).

The waterproof connector 81 includes a connector housing 82 made of synthetic resin, cover 83 made of synthetic resin for covering the connector housing 82, and a cylindrical waterproof packing 85 being mounted on, an outer peripheral surface of an insulating coating of an electric wire 84. The waterproof packing 85 is made of material such as polyester or elastomer.

A rear half of the connector housing 82 is opened, a plate-shaped extending part 86 of a terminal is arranged in an opening of the connector housing 82, the electric wire 84 coated with an insulation is arranged on the terminal extending part 86, the waterproof packing 85 is received in the opening, the waterproof packing 85 is covered with the cover 83 from above, the electric wire 84 and the waterproof packing 85 are pressed by a projection of the cover 83, and on such a condition the cover 83 is ultrasonically vibrated relatively to the connector housing 82.

Both ends 88 of the cover 83 are welded to and integrated with a substrate 87 of the connector housing 82, the insulating coating of the electric wire 84 is melted so that a conductor part of the electric wire 84 is exposed and connected to the terminal extending part 86, and the waterproof packing 85 is melted so as to close the opening of the connector housing 82, thereby preventing water from entering from the outside.

However, as for the conventional waterproof connector and the process for producing the conventional waterproof connector as described above, there is a problem that mechanization of an operation is difficult and many man-hour is required due to troublesome machining since the electric wire 84 must be passed through the cylindrical waterproof packing 85 one by one and a tape-shaped waterproof member must be wound around the waterproof packing 85. Further, when such a member is used that the whole of the waterproof packing is melted, a long time period is required for heating, and when an outer diameter of the waterproof packing 85 is small, there is a problem that upon melting, a gap tends to occur between an outer peripheral surface of the electric wire 84 and an inner peripheral surface of the waterproof packing 85 and between an outer peripheral surface of the waterproof packing 85 and an inner surface of the connector housing 82 that is the side of mounting, resulting in that there are many control-requiring points such as a setting amount of a waterproof member and a position for mounting of the waterproof member, causing unstability of quality. Furthermore, when the cover 83 is melted to adhere to the connector housing 82, the electric wire 84 is melted to adhere to the terminal extending part 86, and simultaneously the waterproof packing 85 is melted to adhere to the connector housing 82, there is a problem that it is difficult to judge whether the waterproof packing 85 is melted or not. Further, since the cover 83 is permanently fixed to the connector housing 82, there is a problem that it is difficult to disassemble the waterproof connector 81 efficiently so as to extract the terminal 86 made of metal for the purpose of maintenance or recycling.

SUMMARY OF THE INVENTION

It is therefore an objective of the present invention to solve the above problem and to provide a waterproof packing, by which waterproofing between an electric wire and a waterproof packing and waterproofing between a waterproof packing and a connector housing can be simply securely carried out so as to improve the waterproof characteristic and also assembly and disassembly between an electric wire and the side of mounting such as a connector housing can be carried out efficiently with good workability, a waterproof connector using such a waterproof packing, and a process for producing such a waterproof connector.

In order to attain the above objective, the present invention is to provide a waterproof packing including:

a core member including an electric wire passing part, through which an electric wire passes, inside and a contacting part for fitting to a mounting side outside; and thermoplastic adhesive adhering to at least the electric wire passing part and the contacting part, wherein the waterproof packing adheres to an electric wire with the thermoplastic adhesive of the electric wire passing part and the waterproof packing adheres to the mounting side with the thermoplastic adhesive of the contacting part by heating.

With the construction described above, an electric wire is passed through the electric wire passing part and the waterproof packing is inserted in the mounting side and heated to melt the thermoplastic adhesive, so that the electric wire adheres to the electric wire passing part without a gap while at the same time an outer peripheral surface of the waterproof packing adheres to an inner peripheral surface of the mounting side without a gap. Therefore, waterproofing is attained. That is, the electric wire is fixed to the electric wire passing part while the waterproof packing is fixed to the mounting side. The electric wire is firmly supported by the core member at the electric wire passing part. The thermoplastic adhesive is pressed by the core member so as to firmly adhere to the electric wire. The mounting side is, for example, a packing receiving part opened on a connector housing made of synthetic resin or an opening (i.e. packing receiving part) for guiding out an electric wire of an electric junction box body (i.e. case or cover). The core member may or may not have elasticity (i.e. either soft or hard). The thermoplastic adhesive is elastically solidified at ordinary temperature and melt to be fluidized by heating. Since the thermoplastic adhesive has not stickiness at ordinary temperature, therefore handling thereof or mounting operation of the waterproof packing to the mounting side is easy.

With the construction described above, the waterproofing of an outer surface of the electric wire and of an inner surface of the mounting side can be securely efficiently carried out with the thermoplastic adhesive. The fixing and assembling of the electric wire to the waterproof packing and of waterproof packing to the mounting side can be simultaneously carried out efficiently at low cost without using any other locking means. Further, the core member situated inside firmly supports the electric wire by pressing a surface of the electric wire and the electric wire can securely adhere to the electric wire passing part with the thermoplastic adhesive, therefore the waterproofing property of the outer periphery of the electric wire can be improved. Since the holding force after the setting of the thermoplastic adhesive can depend on the adhesive force, the waterproofing structure can be simplified or compacted because any large locking means is not used. Further, since, the thermoplastic adhesive has not stickiness at ordinary temperature, therefore handling thereof or mounting operation of the waterproof packing to the mounting side is easy. Since the waterproof packing does not become dirty with the adhesive, therefore the mechanization can be easily carried out. Furthermore, since the thermoplastic adhesive can be melted in order to separate the electric wire, waterproof packing and mounting side from each other, therefore they can be entered into a drier or high temperature tank upon maintenance or recycling so that they can be easily separated from each other.

Preferably, the core member is divided from the electric wire passing part.

With the construction described above, the electric wire is set on a condition that the core member is expanded, the electric wire is held being nipped in the electric wire passing part after the core member is closed, and on that condition the thermoplastic adhesive is heated to be melted. The divided core members are preferably locked with a locking means while the thermoplastic adhesive is melted.

With the construction described above, the electric wire can be set in the core member with the core member being opened and a time period required to adhere the thermoplastic adhesive to the electric wire can be shortened compared to a time period required to pass or wind a conventional waterproof member, therefore the assembling workability for waterproofing between electric wires can be improved.

Preferably, the electric wire passing part consists of an electric wire passing hole, an electric wire passing soft surface for embedding the electric wire therein, a hollow chamber to be filled with the thermoplastic adhesive or an electric wire passing surface for passing a flat electric wire therethrough.

With the construction described above, if the electric wire passing part is an electric wire passing hole, an electric wire is set between respective electric wire passing grooves of both core members, said both core members join together to form the electric wire passing hole, and the thermoplastic adhesive formed on an inner peripheral of the electric wire passing hole is melted by heating, so that the outer peripheral surface of the electric wire adheres to the inner peripheral surface of the electric wire passing hole without forming a gap therebetween. If the electric wire passing part is an electric wire passing soft surface, an electric wire is set making the electric wire passing surface hollow into a groove-shape and the electric wire adheres to the electric wire passing surface with the melted thermoplastic adhesive without forming a gap. Preferably, the core member is a soft rubber material which is adhesive to the thermoplastic adhesive. If the electric wire passing part is a hollow chamber of the core member, the hollow chamber is filled with the thermoplastic adhesive, an electric wire is set between the thermoplastic adhesives, and the electric wire adheres being wrapped in the melted thermoplastic adhesive. An outer wall of the core member prevents the melted thermoplastic adhesive from leaking out and gives elastic force in a nipping direction of the electric wire to the thermoplastic adhesive. If the electric wire passing part is an electric wire passing surface for passing a flat electric wire therethrough, a flat electric wire is set between the electric wire passing surface and the flat electric wire adheres to the electric wire passing surface with the melted thermoplastic adhesive without forming a gap therebetween. If a conductive part of the flat electric wire projects to the outside, the electric wire passing hole is formed communicating with the electric wire passing surface so as to pass the conductive part.

With the construction described above, various electric wires can securely have waterproofing property without forming a gap according to their shape such as round or flat shape. Further, even if the electric wire is pulled after the adhesion, the elasticity of the passing part and the adhesive can relieve the influence, thereby improving the waterproof property.

Preferably, the waterproof packing further includes a slit for inserting an electric wire therethrough, wherein the slit communicates with an electric wire passing hole as the electric wire passing part and the thermoplastic adhesive adheres to the slit.

With the construction described above, an electric wire is inserted into the electric wire passing hole from the slit, the slit adheres to be closed without forming a gap with the melted thermoplastic adhesive, and simultaneously an outer surface of the electric wire adheres to an inner surface of the electric wire passing hole without forming a gap therebetween. Since when the electric wire is inserted, the slit opens toward the outside, it is preferable that the elastic core member is used.

With the construction described above, the electric wire can easily pass through the electric wire passing part without dividing the core member and the slit can be closed with the melted thermoplastic adhesive without forming a gap. Therefore, the waterproof property on the outer periphery of the electric wire can be improved. Further, if the core member is formed with the slit opening wide so that the electric wire can be sufficiently coated upon adhesion, the insertion workability of the electric wire can be further improved.

Preferably, the waterproof packing further includes a waterproof plug mounted or formed on the electric wire passing part which is not utilized.

With the construction described above, the waterproof plug together with the electric wire adheres to the electric wire passing part without a gap with the melted thermoplastic adhesive for the electric wire passing part that is not used, so that the non-used electric wire passing part can securely have waterproof property. As the waterproof plug, one made of synthetic rubber (elastic), one made of synthetic resin (non-elastic), one formed integrally with the core member or one formed integrally or non-integrally with the thermoplastic adhesive can be used.

With the construction described above, the non-used electric wire passing part can have waterproof property with the waterproof plug simultaneously with the adhesion of the other electric wire, therefore the reliability of the waterproofing can be improved. The waterproof plug is effective for waterproofing of non-formed circuit part of a round electric wire. In particular, the mounting operation of the waterproof plug to the flat electric wire can be easily carried out and a non-formed circuit part is sealed by integral formation of the waterproof packing, thereby making the assembly of the waterproof structure of the non-formed circuit part simple.

The present invention is also to provide a waterproof connector including:

the waterproof packing as described above;

a connector housing for inserting an electric wire having a terminal therein; and a packing receiving part of the connector housing, wherein the waterproof packing is inserted in the packing receiving part as the mounting side.

With the construction described above, for example, the electric wire having a terminal is inserted in the connector housing, and the waterproof packing is mounted on the electric wire and inserted into the packing receiving part of the connector housing. Alternatively, the electric wire having a terminal is inserted in the waterproof packing, the electric wire having a terminal is inserted in the connector housing, and simultaneously the waterproof packing is inserted into the packing receiving part. Thereafter, the thermoplastic adhesive is melted by heating, so that an outer surface of the electric wire adheres to an inner surface of the electric wire passing part of the waterproof packing and an outer surface of the waterproof packing adheres to an inner surface of the packing receiving part without a gap simultaneously.

With the construction described above, the waterproofing of the outer periphery of the electric wire and that of the inner surface of the packing receiving part of the connector housing can be simultaneously securely carried out with the thermoplastic adhesive. Also, the fixing between the electric wire and the waterproof packing and that between the waterproof packing and the connector housing can be carried out simultaneously without using any other locking means securely efficiently. Therefore, the reliability of the waterproofing of the waterproof connector and the workability of the assembling operation can be improved. Further, the compact waterproof connector can be produced at low cost.

Preferably, the connector housing consists of: an inner housing for inserting the electric wire having a terminal therein; and an outer housing for inserting the inner housing therein, wherein the packing receiving part is formed on the outer housing.

With the construction described above, for example, the electric wire having a terminal is inserted in the inner housing, and the waterproof packing is mounted on the electric wire and inserted into the packing receiving part of the outer housing while the inner housing is inserted into the outer housing. Thereafter, the thermoplastic adhesive is melted by heating, so that an outer surface of the electric wire adheres to an inner surface of the electric wire passing part of the waterproof packing and an outer surface of the waterproof packing adheres to an inner surface of the packing receiving part without a gap simultaneously. Therefore, the electric wire, the waterproof packing and the outer housing simultaneously adhere and are fixed to each other without forming a gap. The inner housing is pressed, for example, by the waterproof packing in the insertion direction and fixed to the outer housing. The waterproof packing functions as a rear holder having waterproof function with respect to the inner housing.

With the construction described above, the waterproofing of the outer periphery of the electric wire by the thermoplastic adhesive, the waterproofing and fixing between the waterproof packing and the outer housing, and the fixing of the inner housing by the waterproof packing can be simultaneously carried out. Therefore, a locking means for locking the electric wire having a terminal to the inner housing, a locking means for locking the inner housing to the outer housing or a locking means for locking the waterproof packing to the outer housing is not necessary. That is, the waterproof connector can be simplified, low-priced and compacted.

The present invention is also to provide a process for producing a waterproof connector including the steps of:

passing an electric wire through the electric wire passing part of the waterproof packing as described above;

inserting the waterproof packing in a packing receiving part of a connector housing; and heating the waterproof packing to melt the thermoplastic adhesive so that the electric wire adheres to the electric wire passing part and the waterproof packing adheres to the packing receiving part with the melted thermoplastic adhesive, thereby attaining waterproofing of the waterproof connector.

With the construction described above, for example, the electric wire having a terminal is inserted in the connector housing, and the waterproof packing is mounted on the electric wire and inserted into the packing receiving part of the connector housing. Alternatively, the electric wire having a terminal is inserted in the waterproof packing, the electric wire having a terminal is inserted in the connector housing, and simultaneously the waterproof packing is inserted into the packing receiving part. Thereafter, the thermoplastic adhesive is melted by heating, so that an outer surface of the electric wire adheres to an inner surface of the electric wire passing part of the waterproof packing and an outer surface of the waterproof packing adheres to an inner surface of the packing receiving part without a gap simultaneously.

With the construction described above, the waterproofing of the outer periphery of the electric wire and that of the inner surface of the packing receiving part of the connector housing can be simultaneously securely carried out with the thermoplastic adhesive. Also, the fixing between the electric wire and the waterproof packing and that between the waterproof packing and the connector housing can be carried out simultaneously without using any other locking means securely efficiently. Therefore, the reliability of the waterproofing of the waterproof connector and the workability of the assembling operation can be improved. Further, the compact waterproof connector can be produced at low cost.

DESCRIPTION OF THE PREFERRED EMBODIMENTS

In the following, the preferred embodiments of the present invention will be explained with reference to the attached drawings. FIGS. 1-6 illustrate a waterproof packing according to the present invention, a waterproof connector using such a waterproof packing (waterproof structure) and a process for producing such a waterproof connector.

Figure 1:
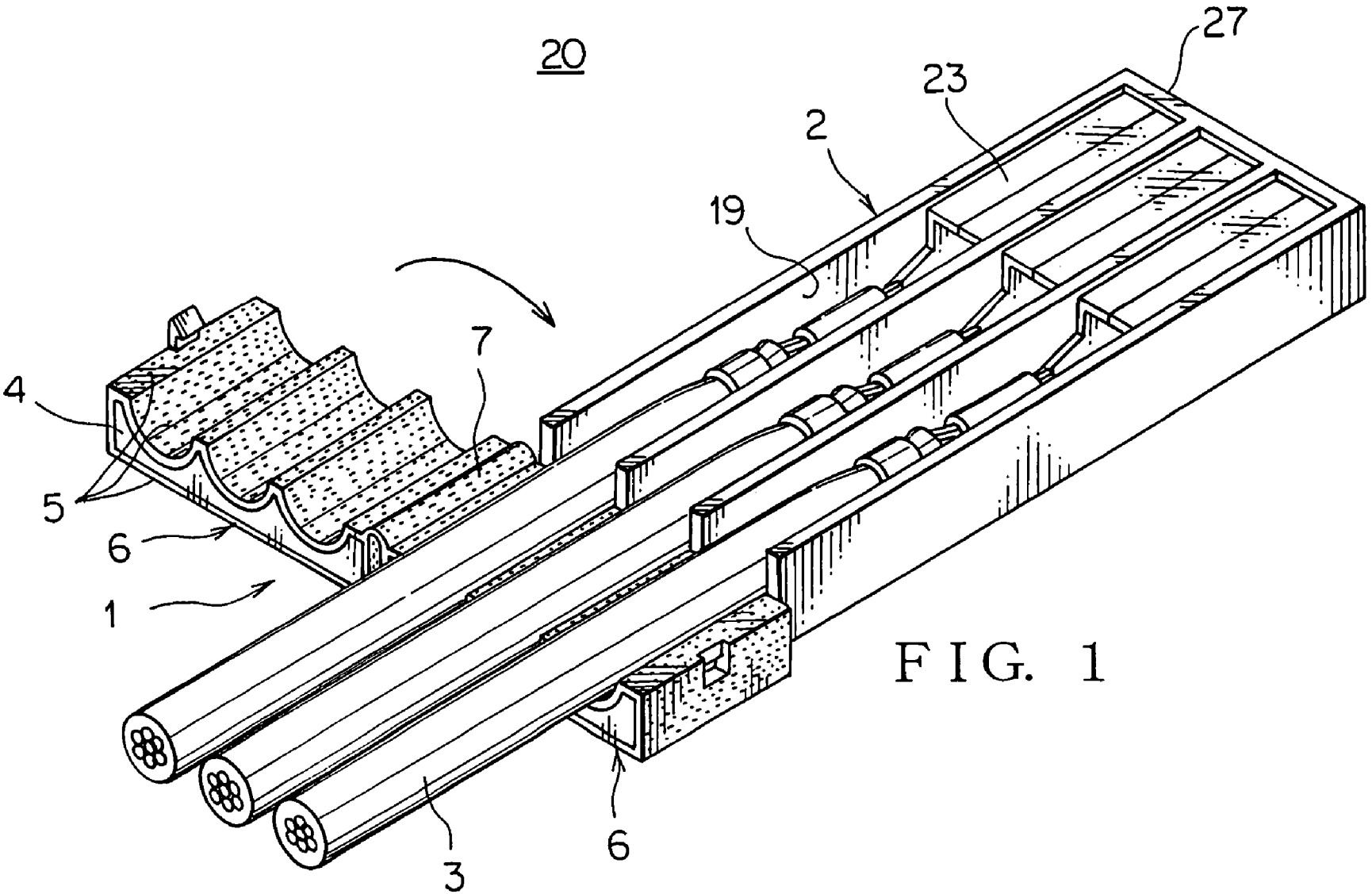
FIG. 1 is a perspective view illustrating a waterproof packing according to the present invention and a process for producing a waterproof connector using the waterproof packing.

In FIG. 1, the reference numeral 1 denotes a waterproof packing, 2 an inner housing made of synthetic resin, and 3 an electric wire having a terminal inserted in the inner housing.

Figure 2:
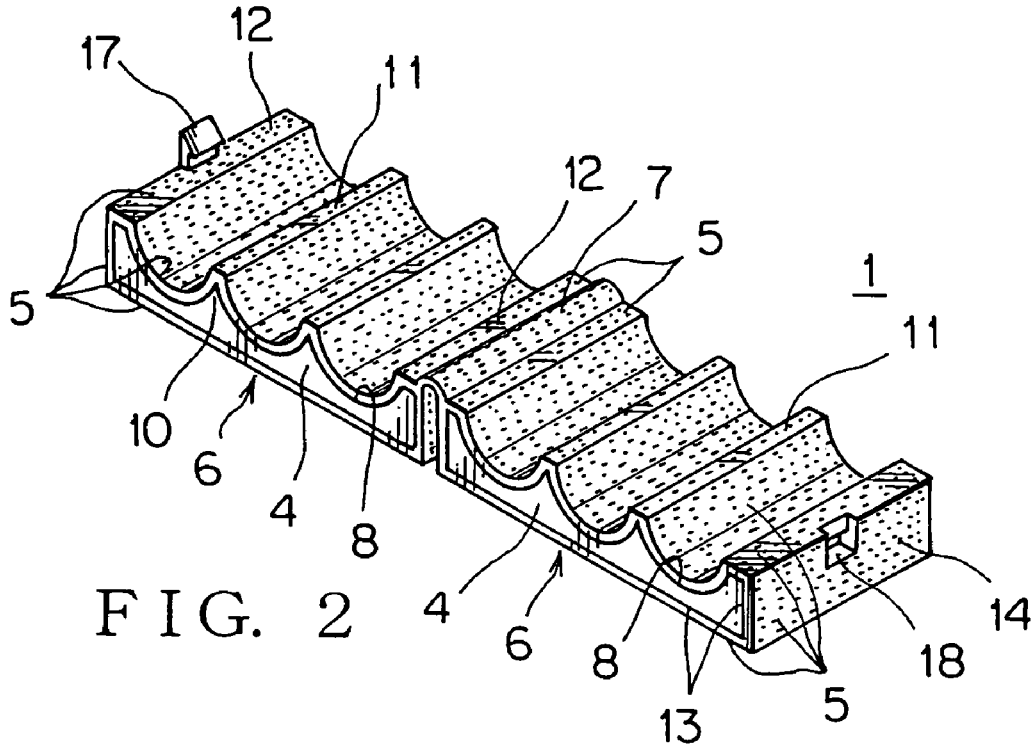
FIG. 2 is a perspective view illustrating a preferred embodiment of the waterproof packing in its expanded state.

As shown in FIG. 2, the waterproof packing 1 includes a core member 4 inside and thermoplastic adhesive 5 outside. The thermoplastic adhesive 5 adheres to an inner surface and outer surface of the core member 4 except end surfaces situated in front and rear of the core member 4. However, there is no practical problem even if the thermoplastic adhesive 5 adheres to the end surfaces situated in front and rear of the core member 4.

The core member 4 is formed with an elastic material such as synthetic rubber or hard material such as synthetic resin. The thermoplastic adhesive 5 is so-called hot melt material, melts by heating (about 110-120° C.) to have fluidity, and is solidified by natural cooling with maintaining the elasticity.

As the elastic material of the core member 4, acrylic rubber, high-speed vulcanization silicone, urethane rubber, NBR, fluororubber and EPDM can be used. As the resin material of the core member 4, PBT, PA, PP, PET and ABS can be used. As the thermoplastic adhesive 5, vinyl acetate resin-based, vinyl chloride-based, α-olefin resin-based and aqueous polymer isocyanate-based adhesive can be used.

The adhesion of the thermoplastic adhesive 5 to the core member 4 may be carried out by dipping or spraying, for example. The dipping is carried out in such a manner that the thermoplastic adhesive is melted by heating in a container made of metal and the core member 5 is dipped in the melted thermoplastic adhesive. If the thermoplastic adhesive is not applied to the end surfaces situated in front and rear of the core member 4, there is a method such as the masking or the dipping of a base material of the long core member 4 followed by cutting. An electric wire passing part 9 and a housing adhesion surface 13 of the core member 4 may be subjected to unevenness formation of a mold for the core member 4 by electric discharge machining or macroscopic unevenness formation so as to facilitate the adhesion of the thermoplastic adhesive 5, thereby improving the holding force after the adhesion.

The spraying is carried out in such a manner that the thermoplastic adhesive is melted by heating in a spray container and the melted thermoplastic adhesive is sprayed in a fog-shape from a nozzle by compressed air so as to spray it to a surface of the core member 4 on a condition that the core member 4 is expanded as shown in FIG. 2. By spraying the melted thermoplastic adhesive all around the surface of the core member 4, the thermoplastic adhesive 5 can uniformly adhere to a desired portion without adhering to the end surfaces in front and rear of the core member 4. The spraying can be carried out aiming a surface which is necessary for adhesion.

Figure 3:
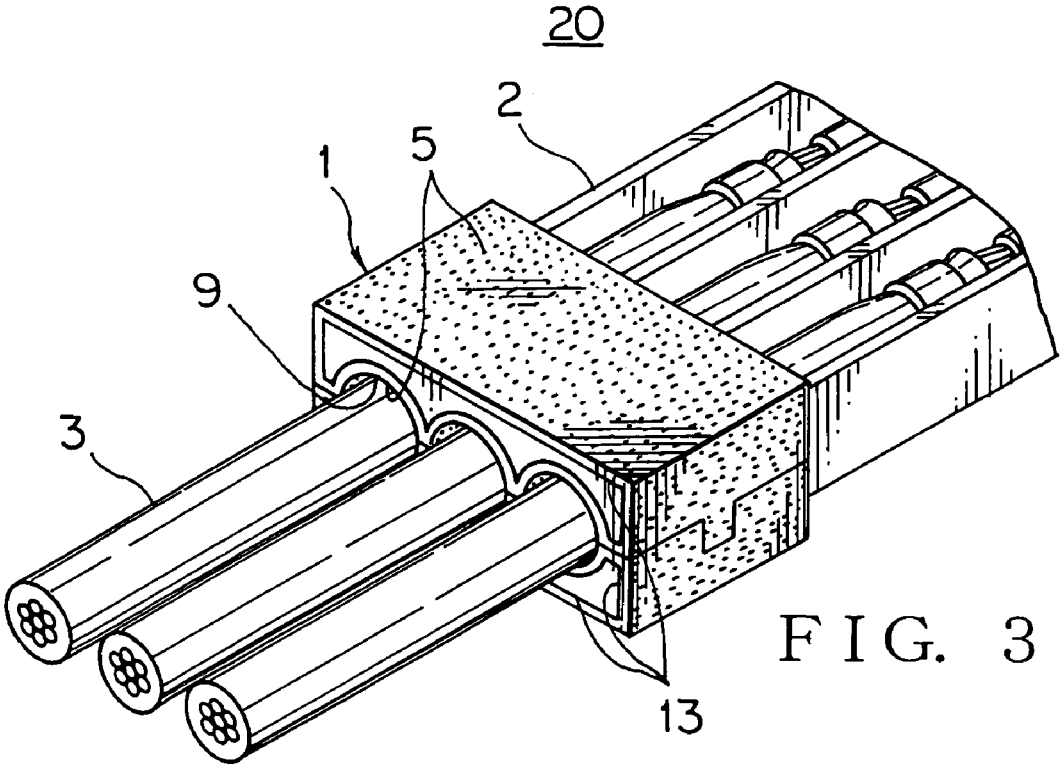
FIG. 3 is a perspective view illustrating a state when electric wires on the side of an inner housing are passed through the waterproof packing.

The waterproof packing 1 shown in FIG. 2 is divided into two pieces up and down and both divided packings 6 is linked by a thin hinge 7 making them possible to be opened and closed. A plurality of electric wire passing grooves 8 having half circle-shape in section are formed having the same pitch (narrow pitch) on an inner surface of the core member 4 of the respective divided packings 6. Both electric wire passing grooves 8 situated up and down are joined to form the electric wire passing hole 9 (electric wire passing part) having a circle shape in section as shown in FIG. 3.

A top surface (divided surface) 11 of a mountain-shaped partition wall 10 situated between the respective electric wire passing grooves 8 of the core members 4 is formed narrow. The thermoplastic adhesive 5 adheres to the narrow top surface (divided surface) 11 of the core member 4, an arc surface of the electric wire passing groove 8, a relatively wide top surface (divided surface) 12 situated at both sides, and both side surfaces and an outer surface up or down, continuously. As an example, if an inner diameter of the electric wire passing hole 9 (see FIG. 3) is 2 mm, the thickness of the thermoplastic adhesive 5 is about 0.2 mm.

Since the narrow top surfaces 11 of both divided packing 6 are joined together, the electric wire passing hole 9 can be securely formed with a narrow pitch compared to a case of no division. In the case of no division, there might be a problem that a partition wall 10 between the respective electric wire passing holes is thin and easily cut. If the thermoplastic adhesive 5 adheres to at least one of the top surfaces (divided surfaces) 11 and 12 of the divided packings 6, both divided packings 6 can adhere to each other.

Figure 4:
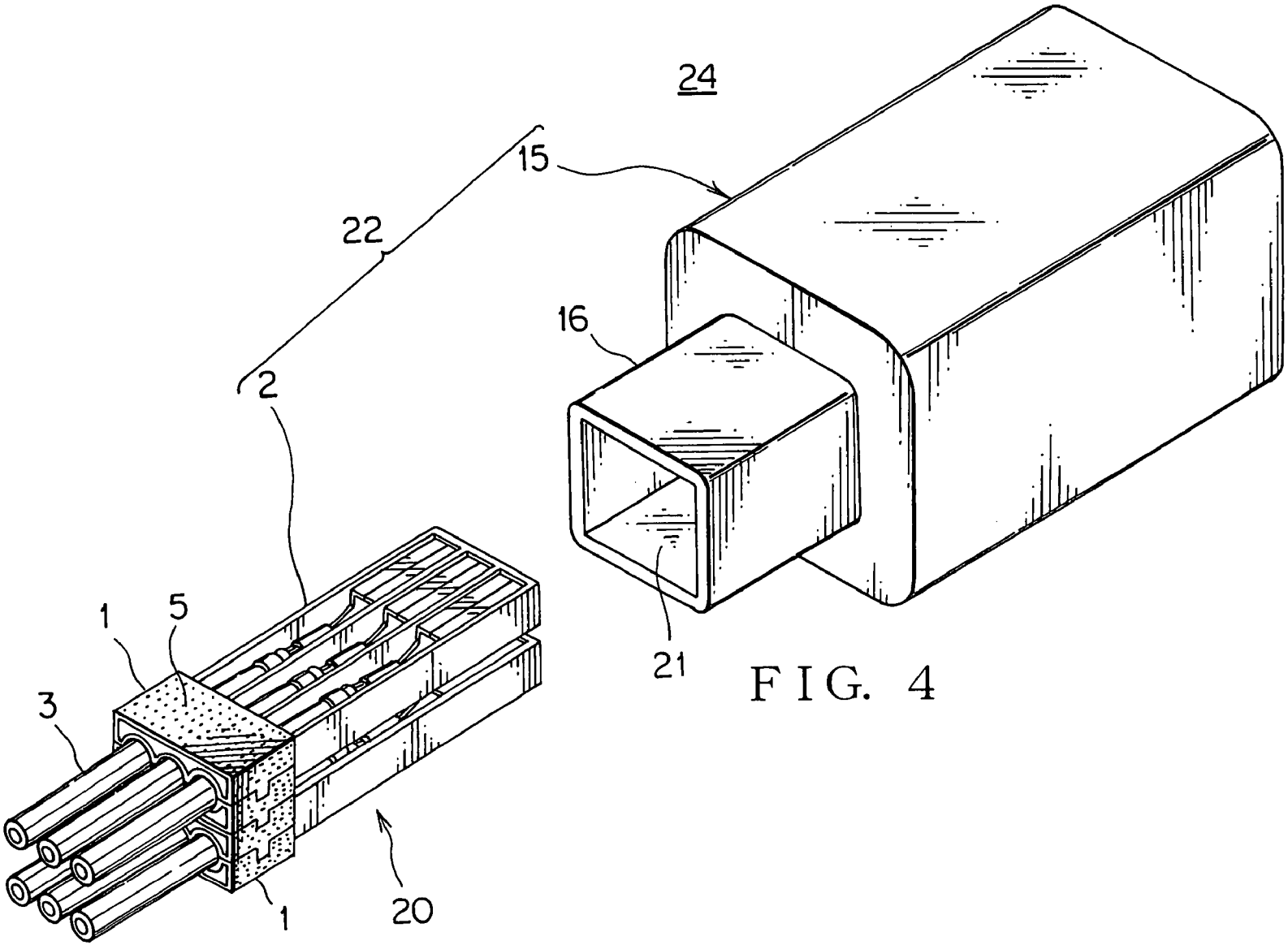
FIG. 4 is an exploded perspective view illustrating a state when an inner housing and waterproof packing are inserted into an outer housing.

An outer peripheral surface (contacting part) 13 of the core member 4 of each divided packing 6, that is, an outer surface up or down and a side surface is formed flat so that it is inserted into a rectangular cylindrical shaped packing receiving part 16 situated at rear end of the outer housing 15 made of synthetic resin shown in FIG. 4. As shown in FIG. 2, preferably, a flexible locking claw 17 and an engaging recess 18 as a locking means are formed symmetrically on a side surface situated at an opposite side of a hinge 7. The locking claw 17 is flush with a side surface 14 on the side of the engaging recess 18 and does not project to the outside from the side surface 14 on a locked condition.

The locking means 17 and 18 is for provisionally fixing the electric wire 3 having a terminal from when both divided packings 6 are joined together to when the thermoplastic adhesive 5 is heated. It is possible that a cylindrical locking boss (not shown) is used instead of the locking claw 17 and an engaging hole (not shown) is used instead of the engaging recess 18 so that the thermoplastic adhesive 5 located on a surface of the boss is press-fit into the engaging hole so as to lock the electric wire 3 having a terminal. Instead of the locking means, the electric wire 3 having a terminal can be held by a clamp as a different member on a condition that both divided packings 6 are joined together.

In FIG. 1, the waterproof packing 1 is preferably arranged close to or coming in contact with a rear end surface of the inner housing 2. The electric wire 3 having a terminal is inserted into the inner housing 2 downward from an upper opening 19 and thereafter or simultaneously, the electric wire 3 is inserted into each electric wire passing groove 8 of the lower divided packing 6 downward from above. Thereafter, the upper divided packing 6 is rotated around the hinge 7 so as to join it to the lower divided packing 6 as shown in FIG. 3.

Therefore, each electric wire 3 is held with the elastic thermoplastic adhesive 5 formed on a surface of the electric wire passing groove 8 and the elastic friction force of the thermoplastic adhesive 5 prevents the electric wire 3 from shifting in the longitudinal direction. Since the thermoplastic adhesive 5 does not have adhesive property and is not sticky upon passing operation of the electric wire 3 at ordinary temperature, therefore the operation is easy. A coating of the electric wire 3 is made of material which is not melted at a melting temperature of the thermoplastic adhesive 5.

A primary assembly (inner assembly) 20 consisting of the inner housing 2, electric wires 3 and waterproof packing 1 is inserted into a packing receiving part (mounting side) 16 consisting of rectangular cylindrical peripheral wall of the outer housing 15 as shown in FIG. 4. The insertion of the inner assembly 20 is performed until the waterproof packing 1 is completely inserted in the packing receiving part and the insertion of the waterproof packing 1 is performed while the thermoplastic adhesive adhering on the outer peripheral surface (contacting part) 13 is slidably coming contact with an inner surface 21 of the packing receiving part 16, in a comparatively press-fitting manner. Since the waterproof packing 1 is not sticky at all, therefore the insertion operation is easy. Therefore, for example, upon mechanization of the assembling, the assembly is possible by using a parts feeder or robot arm, that is, the filling step of the adhesive is not necessary. The inner housing 2 and the outer housing 15 construct the connector housing 22.

Figure 6:
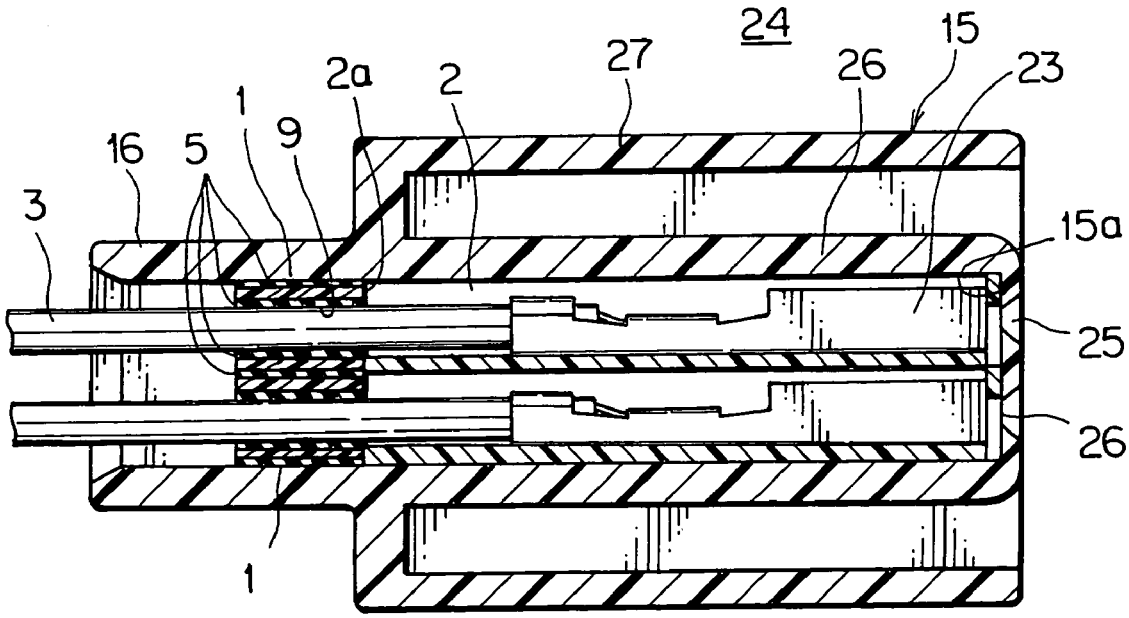
FIG. 6 is a longitudinal cross sectional view illustrating a preferred embodiment of a waterproof connector.

In a preferred embodiment shown in FIG. 4, the inner assembly 20 having two steps joined together up and down are inserted into the outer housing 15. When the number of poles of the terminal 23 (see FIG. 1) of the electric wire 3 is small, the inner assembly 20 having single step (see FIG. 3) can be inserted into an outer housing 15 which is smaller than the outer housing shown in FIG. 4. In both cases, as shown in FIG. 6, the waterproof packing 1 is preferably pressed thereinto until it abuts against a rear end surface 2*a* of the inner housing 2. A front end surface 2*b* of the inner housing 2 abuts against a front end inner surface 15*a* of the outer housing 15 without looseness. Surfaces denoted by reference numerals 5 and 21 in FIG. 4 may be formed in a tapered shape, so that a pressure upon the adhesion is applied to the outer housing 15 by the force for inserting and holding the inner assembly 20. Alternatively, an interface affinity agent such as a primer may be applied to a surface denoted by reference numeral 21.

Figure 5:
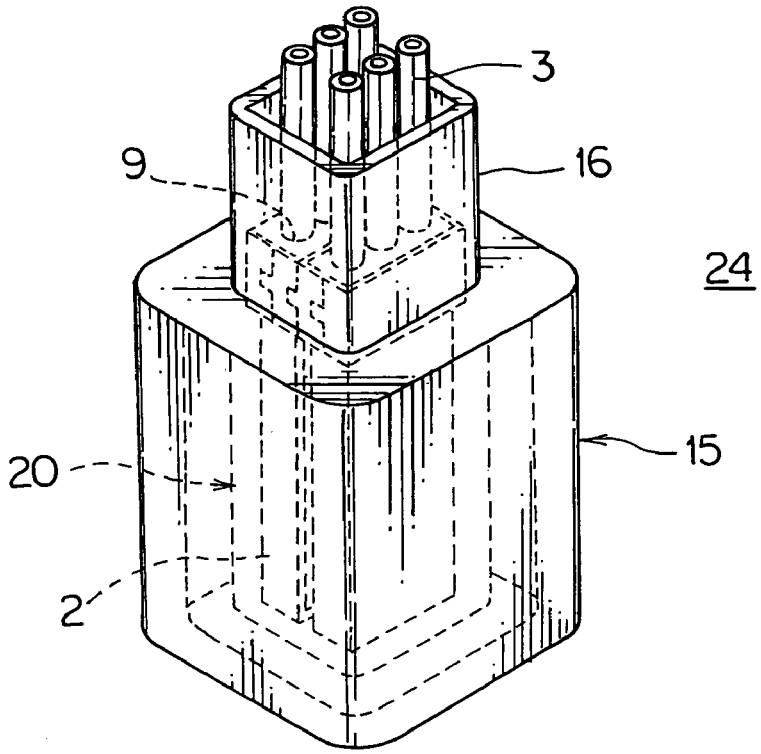
FIG. 5 is a perspective view illustrating a state when a waterproof packing is heated to form a waterproof connector.

As shown in FIG. 5, on a condition that the inner assembly 20 is inserted in the outer housing 15, heat is added to the thermoplastic adhesive 5 from the outside so that the thermoplastic adhesive 5 situated on the inner peripheral surface of the electric wire passing hole 9 of the waterproof packing 1 is melted, so that a gap between the inner peripheral surface of the electric wire passing hole 9 and the outer peripheral surface of the electric wire 3 is closed while the outer peripheral surface of the electric wire 3 and inner peripheral surface of the electric wire passing hole 9 adhere to each other being fixed to each other. Simultaneously, the thermoplastic adhesive 5 situated on the outer peripheral surface (contacting part) 13 of the waterproof packing 1 is melted, so that a gap between the outer peripheral surface (contacting part) 13 of the waterproof packing 1 and the inner peripheral surface of the packing receiving part 16 of the outer housing 15 is closed while the outer peripheral surface of the waterproof packing 1 and inner peripheral surface of the packing receiving part 16 adhere to each other being fixed to each other. Simultaneously, the divided packings 6 up and down (or left and right) adhere to each other with the thermoplastic adhesive 5 situated on the divided surfaces 11 and 12 (see FIG. 2) so as to firmly fixed to each other. Simultaneously, the waterproof packings 1 laminated up and down (see FIG. 6) adhere to each other being fixed to each other by the thermoplastic adhesive 5 situated on the outer peripheral surface. Thereby, a waterproof connector 24 shown in FIG. 6 is completed.

Since there is no gap between the outer peripheral surface of the electric wire 3 and the inner peripheral surface of the electric wire passing hole 9 and between the outer peripheral surface of the waterproof packing 1 and the inner peripheral surface of the outer housing 15, therefore water is securely prevented from entering into the waterproof connector 24 from the outside. The waterproofing of a terminal-inserting hole 25 situated at a front end of the outer housing 15 shown in FIG. 6 is attained by a rubber packing (not shown) situated between a main housing 26 inside and a hood part 27 outside upon fitting to a mating connector (not shown).

When hard synthetic resin is used as the core member 4, there is no bending deformation of the electric wire passing hole 9 in comparison with a case when soft rubber is used as the core member 4, therefore contacting pressure between the outer peripheral surface of the electric wire 3 and the inner peripheral surface of the electric wire passing hole 9 is increased, so that the adhesion force between the electric wire 3 and the waterproof packing 1 is increased. Such an effect is obtained when soft rubber is used as the core member 4. This feature is advantageous for a case in which the mounting distance between respective terminals is narrow (i.e. fine pitch). Even if there is a gap before the heating, the adhesive, the viscosity of which is decreased upon the heating, closes such a gap by capillary action.

Since the electric wire 3 adheres and fixed to the waterproof packing 1, the waterproof packing 1 adheres and fixed to the outer housing 15, and the inner housing 2 is fixed by being pressed in the outer housing 15 (in a case when the thermoplastic adhesive 5 adheres to the front end surface of the waterproof packing 1, the inner housing 2 is fixed by adhesion), therefore the electric wire 3 having a terminal and the outer housing 15 are fixed to each other. That is, there is no need to have any locking means such as a locking means between the inner housing 2 and the outer housing 15, a locking means between the terminal 23 and the inner housing 2 and a locking means between the waterproof packing 1 and the outer housing 15 or the inner housing 2. Thereby, the connector structure can be simplified, compacted and produced at low cost.

Further, since both divided packings 6 adhere to each other with the thermoplastic adhesive 5 situated on the divided surfaces 11 and 12 (see FIG. 2), therefore there is no need for the locking means 17 and 18 (see FIG. 2) to exhibit a very strong locking force, thereby the connector structure can be simplified and compacted. The locking force of the locking means 17 or 18 is not necessarily very strong since the locking means 17 or 18 is only for provisional locking.

In FIG. 3, when there is the electric wire passing hole 9 through which no electric wire 3 passes depending on a circuit form, preferably a rubber material for waterproofing or a waterproof plug made of synthetic resin is inserted in the electric wire passing hole 9 or, alternatively, a rod-shaped thermoplastic adhesive 5 is inserted as a waterproof plug, so that the melted thermoplastic adhesive 5 adheres to an inner surface of the electric wire passing hole 9 so as to close the electric wire passing hole 9 without forming a gap. Preferably, the waterproof plug has a flange for preventing itself from coming out at front and rear ends thereof. If a non-used electric wire passing hole 9 is known in advance, it is possible that one core member 4 of the division-type waterproof packing 1 is provided with an arc-shaped projecting strip (waterproof plug which is not shown in the figure) having a sectional shape of the electric wire passing groove 8 and the projecting strip is engaged with the electric wire passing groove 8 of the other core member 4 so as to attain the waterproofing with the thermoplastic adhesive 5 or, alternatively, the electric wire passing groove 8 of the core member 4 is plugged up with the thermoplastic adhesive (i.e. waterproof plug) 5 having a half circle in section. Thus, it is possible that a somewhat larger quantity of the thermoplastic adhesive 5 in advance adheres to the electric wire passing hole 9 so that the non-used electric wire passing hole 9 is plugged up with the thermoplastic adhesive 5. Such a method is particularly effective as a sealing means for sealing the electric wire passing hole that is not used in a circuit in which a flat electric wire (see FIG. 12) is used.

Since the waterproof packing 1 exhibits an action (waterproofing action) of a known rubber packing and also an action (holding action) of a rear holder which prevents the rubber packing from coming out, therefore the number of parts can be reduced and the connector can be compacted in its longitudinal direction.

As a method of heating the thermoplastic adhesive 5, for example, it is preferable that as shown in FIG. 5 the waterproof connector 24 is set facing downward (the electric wire 3 facing upward) or facing laterally, placed on a conveyer and passed through a heating furnace having a temperature of about 110-120° C. or, alternatively, a plurality of the waterproof connectors 24 are entered in a temperature controlled bath so as to be heated. A reason why the waterproof connector 24 is set facing downward is to prevent the waterproof packing 1 from coming out upon melting of the thermoplastic adhesive 5.

In FIG. 1, the waterproof packing 1 is arranged adjacent to a rear end of the inner housing 2. However, instead, after the electric wire 3 having a terminal is inserted in the inner housing 2, the waterproof packing 1 is mounted to the electric wire 3 at a rear of the inner housing 2 and the waterproof packing 1 is shifted along the electric wire 3 with a hand until the waterproof packing 1 approaches closely to or abuts against the inner housing 2 and thereafter, the inner assembly 20 is mounted to the outer housing 15 as shown in FIG. 4.

In the preferred embodiment described above, the division-type waterproof packing 1 is used to improve the mounting property of the electric wire 3. However, instead, it is possible that a non-division-type waterproof packing 1 is used and the electric wire 3 is passed through in the longitudinal direction from an opening of the electric wire passing hole 9 so as to obtain a state shown in FIG. 3. Further, in a case when the division-type waterproof packing 1 is used, both divided packings 6 can be locked by using a locking means without using a hinge 7 (see FIG. 2).

As the locking means, locking means of various types (provided that it does not project to the outside) such as a locking claw 17 and engaging recess 18, locking boss and engaging hole, and locking arm and engaging recess can be used according to a need.

The waterproof connector 1 shown in FIG. 6 uses the inner housing 2, the upper part of which is opened as shown in FIG. 1. However, the upper part of the waterproof connector 1 is not necessarily opened. It is possible to use an inner housing 2, the every side of which is surrounded. The terminal 23 of the electric wire having a terminal may be one which is connected to the electric wire by pressure welding instead of crimping.

In the preferred embodiment described above, the terminal 23 is a female terminal and the inner housing 2 has an insertion hole for a mating male terminal on a front end wall 27 (see FIG. 1) on a condition that the inner housing 2 receives the whole length of the female terminal 23 therein. However, if a male terminal is to be received instead of the female terminal 23, it is possible that only an electric wire-connecting part of the male terminal is received in the inner housing 2 and a tab-shaped electric contacting part of a front half of the male terminal is made project forward from the front end wall of the inner housing so that a connector fitting chamber for a mating connector is formed inside the outer housing (the hood part 27 being unnecessary).

Figure 7:
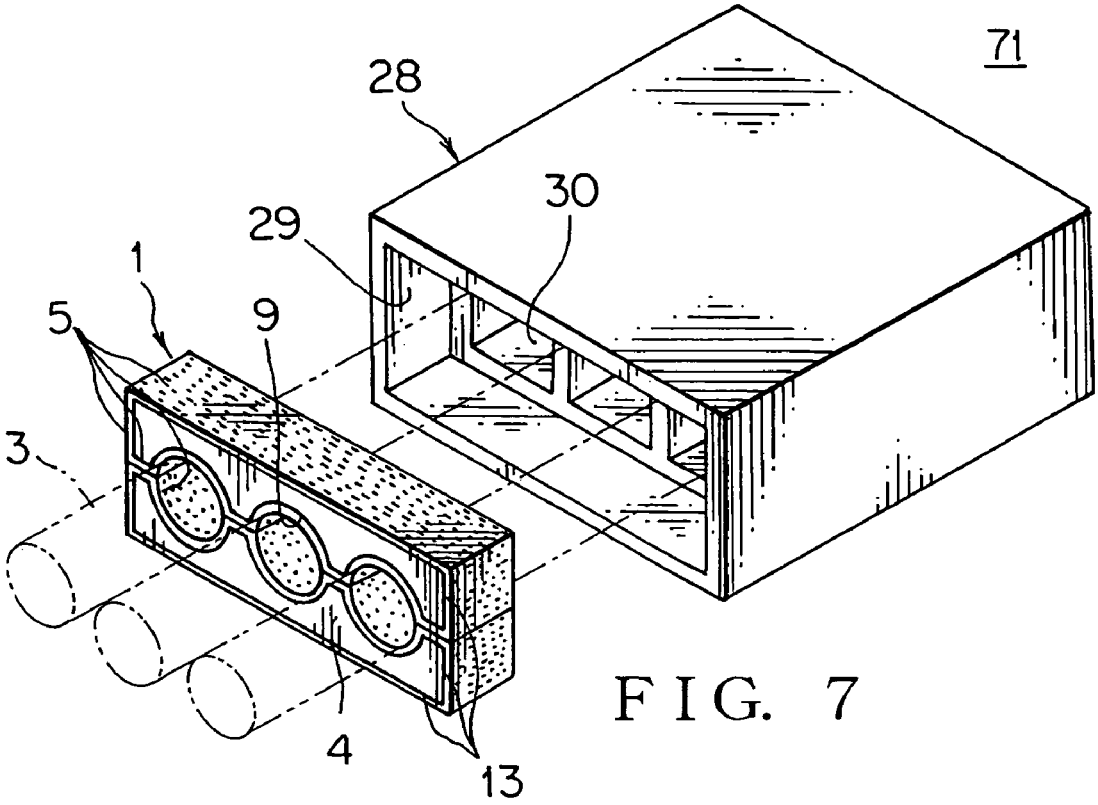
FIG. 7 is an exploded perspective view illustrating another preferred embodiment of a waterproof connector.

Further, as shown in FIG. 7, it is possible that a packing receiving part (mounting side) 29 as an opening for receiving the waterproof packing 1 is formed in the rear end part of a rectangular box-shaped connector housing 28 having no hood part, on a condition that a plurality of terminal-receiving chambers 30 are formed in parallel on the front side of the packing receiving part 29, the waterproof packing 1 is inserted in the packing receiving part 29, the waterproof packing 1 is heated from the outside, so that the melted thermoplastic adhesive 5 glues the electric wire 3 to the inner surface of the electric wire passing hole 9, simultaneously the outer peripheral surface (contacting part) 13 of the core member 4 is glued to the inner surface of the packing receiving part 29 of the connector housing 28, thereby constructing a waterproof connector 71. The waterproof packing 1 is a division-type in this case, however, it can be a non-division-type. Also, a plurality of the waterproof packings 1 can be laminated. The non-used electric wire passing hole 9 can be provided with a waterproof plug and attained waterproofing with the thermoplastic adhesive 5.

Figure 8:
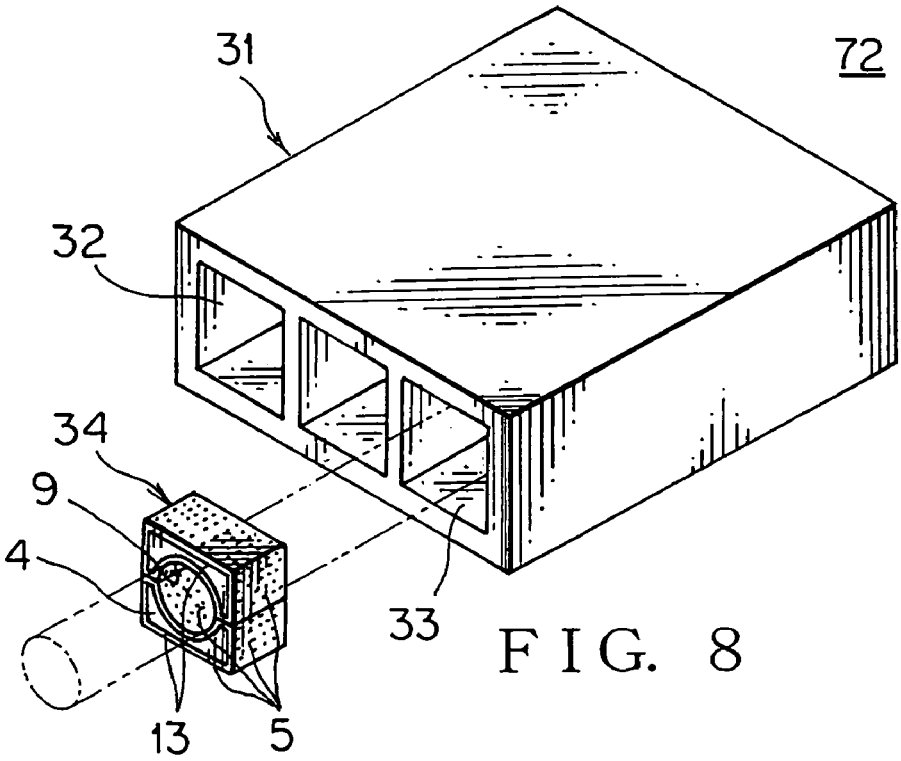
FIG. 8 is an exploded perspective view illustrating a further preferred embodiment of a waterproof connector.

As shown in FIG. 8, it is possible that each separated waterproof packing 34 is one by one inserted in a corresponding packing receiving part (mounting side) 33 as an opening at a rear end of a terminal-receiving chamber 32 of a rectangular box-shaped connector housing 31, the melted thermoplastic adhesive 5 glues the electric wire 3 to the inner surface of the electric wire passing hole 9 of the core member 4 and glues the outer peripheral surface (contacting part) 13 of the core member 4 to the inner surface of a packing receiving part 33 of a connector housing 31, thereby constructing a waterproof connector 72. If a diameter of the electric wire is small, the packing receiving part 33 is preferably larger than the terminal-receiving chamber 32 from the viewpoint of insertion operation. The waterproof packing 34 is a division-type in this case, however, it can be a non-division-type. The non-used electric wire passing hole 9 can be provided with a waterproof plug and attained waterproofing with the thermoplastic adhesive 5.

In the preferred embodiment described above, a rectangular waterproof packing 1, 34 is formed according to a rectangular connector housing 22, 28, 31. However, it is possible that a round waterproof packing is formed according to a connector housing having a round shape (cylindrical shape) in section, the round waterproof packing is provided with one or a plurality of electric wire passing holes in a radial shape, and the thermoplastic adhesive of the waterproof packing is melted by heating so that waterproofing between the electric wire and the waterproof packing and waterproofing between the waterproof packing and the connector housing is attained. If the round waterproof packing is a division-type, preferably, it is divided into a concentric circle-shape (ring-shape) or into three pieces and the electric wire passing hole is arranged on each division surface.

The waterproof structure using each waterproof packing 1, 34 as described above can be applied to a structure in which the waterproof packing 1, 34 is mounted to a connector housing (not shown in the figure) formed integrally with an upper cover or lower cover made of synthetic resin of an electric junction box.

Figure 9:
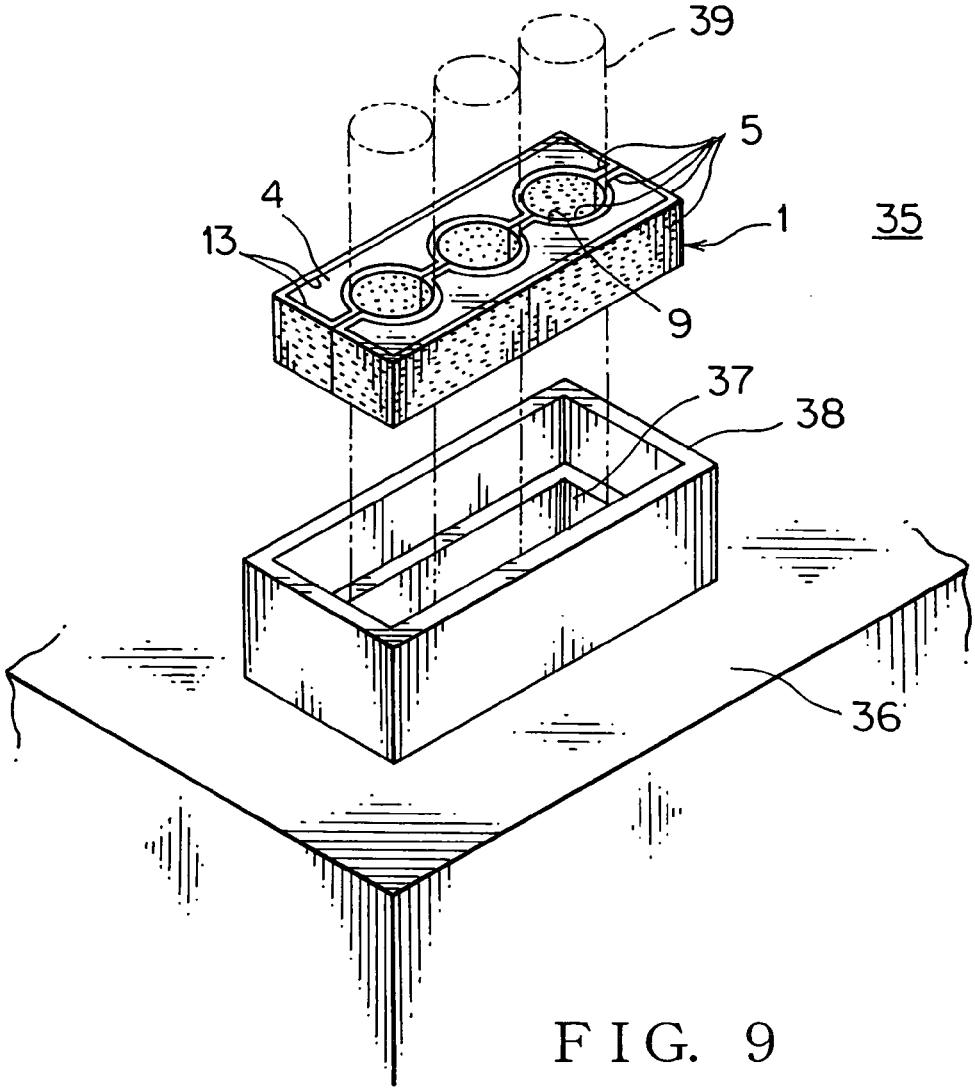
FIG. 9 is an exploded perspective view illustrating a preferred embodiment when a waterproof packing is mounted on an electric junction box.

As shown in FIG. 9, it is possible that an opening 37 for guiding out an electric wire is formed on a cover (electric junction box body) 36 made of synthetic resin of an electric junction box, a packing receiving part (mounting side) 38 consisting of a housing-shaped peripheral wall is formed integrally around the opening 37, the waterproof packing 1 together with the electric wire 39 is inserted in the packing receiving part, the thermoplastic adhesive 5 is melted by heating, so that waterproofing is attained between the electric wire 39 and the outer surface of the electric wire passing hole 9 of the core member 4 and waterproofing is attained between the outer peripheral surface (contacting part) 13 of the core member 4 and the inner surface of the packing receiving part 38 as the mounting side. The packing receiving part 38 may be a recess which does not project toward the outside. The non-used electric wire passing hole 9 can be provided with a waterproof plug and attained waterproofing with the thermoplastic adhesive 5. Each construction shown in FIGS. 6-9 is effective as a waterproof structure using a waterproof packing.

Figure 10:
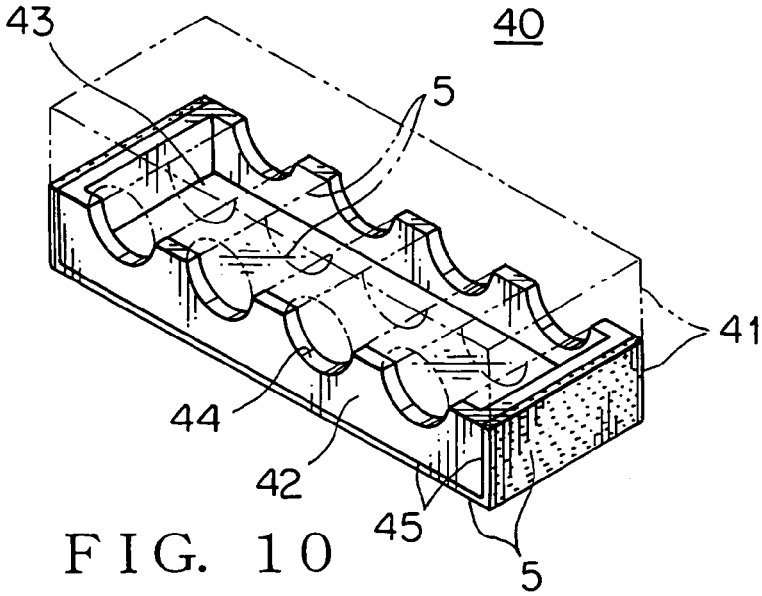
FIG. 10 is a perspective view illustrating another preferred embodiment of a waterproof packing.

FIG. 10 shows another embodiment of a waterproof packing, in which instead of the solid waterproof packing 1 as described above, each core member 42 of this waterproof packing 40 (a pair of divided packings 41) has hollow chambers (electric wire passing part) 43 surrounded by a bottom wall (top wall), front wall, rear wall and both side walls, each hollow chamber is filled with the thermoplastic adhesive 5 in advance, the electric wire 3 is supported by an electric wire passing groove 44 situated on a front and rear wall of a lower divided packing 41, an upper divided packing is then applied, the thermoplastic adhesive 5 inside together with the thermoplastic adhesive 5 situated on the outer surface is melted by heating, the thermoplastic adhesive 5 situated in the hollow chamber is glued to the outer peripheral surface of the electric wire 3, and simultaneously the thermoplastic adhesive 5 situated on the outer peripheral surface (contacting part) 45 is glued to the mounting side such as a connector housing or an electric junction box body.

Preferably, the box-shaped core member 42 of the waterproof packing 40 is filled with the thermoplastic adhesive 5 existed in the hollow chamber by injection molding or the like in a shape of the electric wire passing groove 8 shown in FIG. 2 as shown with a chain line 5 in FIG. 10. Strictly speaking, anticipating a melting room, the thermoplastic adhesive 5 existed in the hollow chamber preferably projects a little higher than the height of the core member 4. An inner peripheral surface of the electric wire passing groove 44 of the divided packings 41 up and down adheres to an outer peripheral surface of the electric wire, thereby preventing the thermoplastic adhesive 5 existed in the hollow chamber from melting out toward the outside upon heating.

If a material harder than the thermoplastic adhesive 5 is used as the core member 42, since the core member 42 gives force in a nipping direction of the electric wire to the thermoplastic adhesive 5 existed in the hollow chamber, the adhesion force between the outer surface of the electric wire and the inner surface of the electric wire passing hole (44) of the thermoplastic adhesive 5 is increased, thereby improving the waterproofing property. If an insulating coating made of synthetic resin of the electric wire 3 is made enter into an edge of the electric wire passing groove 44 situated on a front and rear wall of the core member 42 when the divided packings 41 situated up and down are closed, the electric wire 3 is prevented from shifting in the longitudinal direction thereof by catching force generated when the force acting to the electric wire 3 in the pulling out direction of the electric wire 3 acts, so that the adhesion between the electric wire 3 and the thermoplastic adhesive 5 is secured. If the thermoplastic adhesive 5 is applied on an inner peripheral surface of the electric wire passing groove 44 in advance, the waterproofing property is improved. The non-used electric wire passing hole (44) can be provided with a waterproof plug and attained waterproofing with the thermoplastic adhesive 5. Alternatively, a waterproof plug formed integrally with the thermoplastic adhesive 5 applied in the core member plugs up the electric wire passing groove of the thermoplastic adhesive 5, thereby attaining waterproofing.

Figure 11:
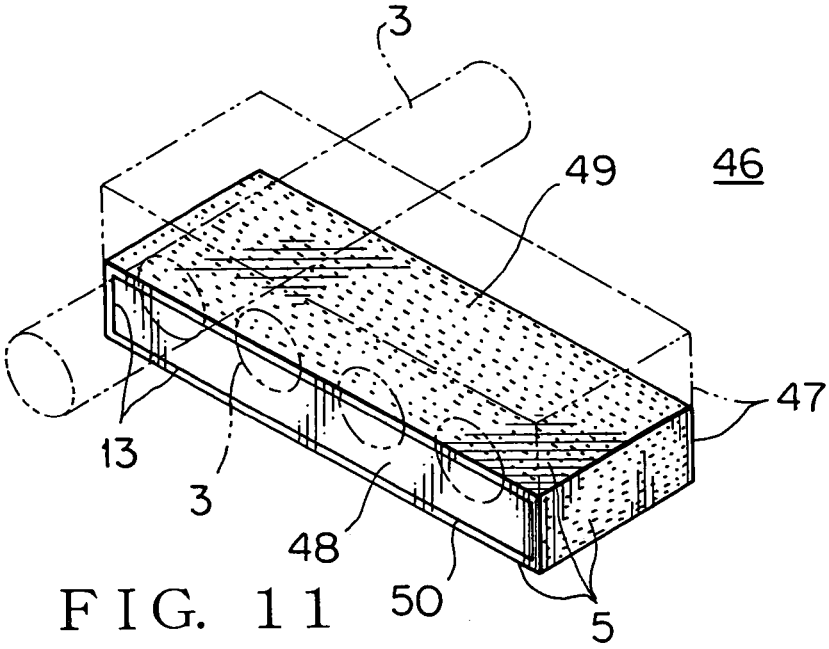
FIG. 11 is a perspective view illustrating a further preferred embodiment of a waterproof packing.

FIG. 11 shows a further embodiment of a waterproof packing, in which this waterproof packing 46 (a pair of divided packings 47) has a soft elastic plate-shaped core member 48 inside and the thermoplastic adhesive 5 is glued to the outer peripheral surface of the core member 48. The core member has a flat electric wire passing surface (electric wire passing part) 49 inside and a flat contacting surface (contacting part) 50 outside.

The electric wires 3 are arranged in parallel between the electric wire passing surfaces 49 situated inside the divided packings 47 up and down, the electric wire 3 is put between the divided packings 47 situated up and down, so that the electric wire 3 compresses each soft core member 48 and entered into the inside of the core member 48 by a size of a radius of the electric wire 3, then on this condition the thermoplastic adhesive 5 is melted by heating, thereby attaining waterproofing between the electric wire 3 and the core member 48 and waterproofing between the outer peripheral surface (contacting part) 13 of the core member 48 and the inner peripheral surface of the mounting side such as a connector housing or an electric junction box body. The electric wire passing surfaces 49 situated up and down are automatically adhere to each other, thereby attaining waterproofing, even if a waterproof plug is not used.

In each preferred embodiment described above, the round electric wire 3, 39 is used. However, it is possible that a flat electric wire 51 is used instead of the round electric wire. In this case, each core member 54 of the waterproof packing 52 (a pair of divided packings 53) is provided with, for example, a rectangular electric wire passing groove 57 according to a shape of a projection part 56 of an insulating coating around a conductive part 55 of the flat electric wire 51. A belt-shaped linked coating 60 situated between the conductive parts 55 of the flat electric wire 51 is arranged on a top surface 59 of a partition wall 58 situated between the respective electric wire passing grooves 57. An inner surface of the electric wire passing groove 57 and the top surface 59 compose the electric wire passing surface (electric wire passing part) 61.

The flat electric wire 51 is put between the electric wire passing surfaces 61 of the divided packings 53 situated up and down, on this condition it is inserted in the mounting side such as a connector housing or electric junction box body, and the thermoplastic adhesive 5 situated on the inner and outer peripheral surfaces is melted by heating, so that waterproofing between the flat electric wire 51 and the core member 54 and waterproofing between the outer peripheral surface (contacting surface) 13 of the core member 54 and the inner peripheral surface of the mounting side is attained. The core member 54 may be elastic material or hard synthetic resin. The non-used electric wire passing hole (57) can be provided with a waterproof plug and attained waterproofing with the thermoplastic adhesive 5. Up to now, waterproofing of a non-circuit part (i.e. part in which a conductive part 55 does not exist) of the flat electric wire 51 has been very difficult. However, a rectangular waterproof plug is mounted to the non-circuit part in advance or, alternatively, a rectangular waterproof plug is formed integrally with the thermoplastic adhesive 5, so that the waterproofing of the non-circuit part of the flat electric wire 51 can be securely simply carried out.

Figure 12:
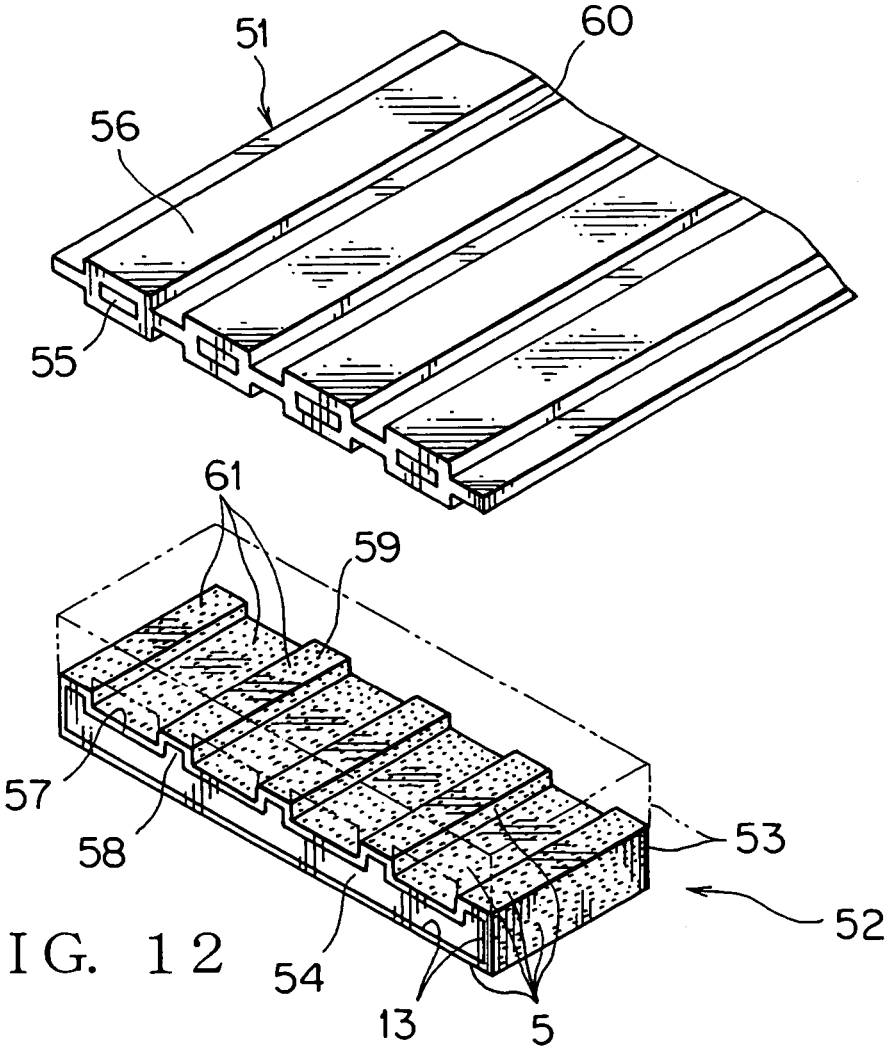
FIG. 12 is an exploded perspective view illustrating a preferred embodiment when flat electric wires are mounted on a waterproof packing.

The flat electric wire 51 shown in FIG. 12 includes a relatively thick conductive part 55. However, if the conductive part 55 is thin part such as a copper foil or printed circuit, since the thickness including an insulating coating of the flat electric wire is approximately uniform for the whole width thereof, it is not necessary for the waterproof packing 52 to have an electric wire passing groove 57 and instead, the core member 54 is provided with a flat electric wire passing surface (electric wire passing part).

Figure 13:
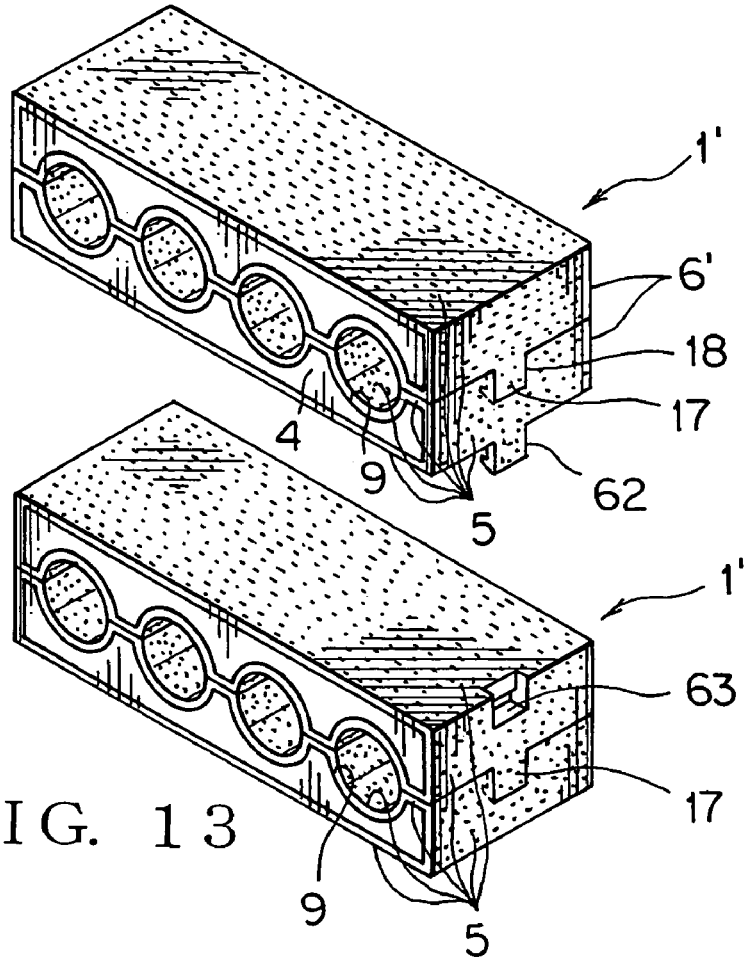
FIG. 13 is an exploded perspective view illustrating an embodiment when waterproof packings are laminated in a multi-layer form.

FIG. 13 shows a structure in which a plurality of waterproof packings 1' are laminated in accordance with the embodiment shown in FIG. 4, one waterproof packing 1' is provided with a locking claw 62 as a locking means, while another waterproof packing 1' is provided with an engaging recess 63 for engaging with the locking claw 62. The locking claw 62 and the engaging recess 63 are the same as the locking claw 17 and the engaging recess 18 as a locking means for joining the respective divided packings 6'. The number of the laminations may be two, three, four or more depending on the number of connection circuits of the electric wire 3 having a terminal. In FIG. 13, the reference numeral 5 denotes thermoplastic adhesive 5 and the reference numeral 9 denotes an electric wire passing hole 9 similar to those of the embodiment shown in FIG. 2.

Figure 14:
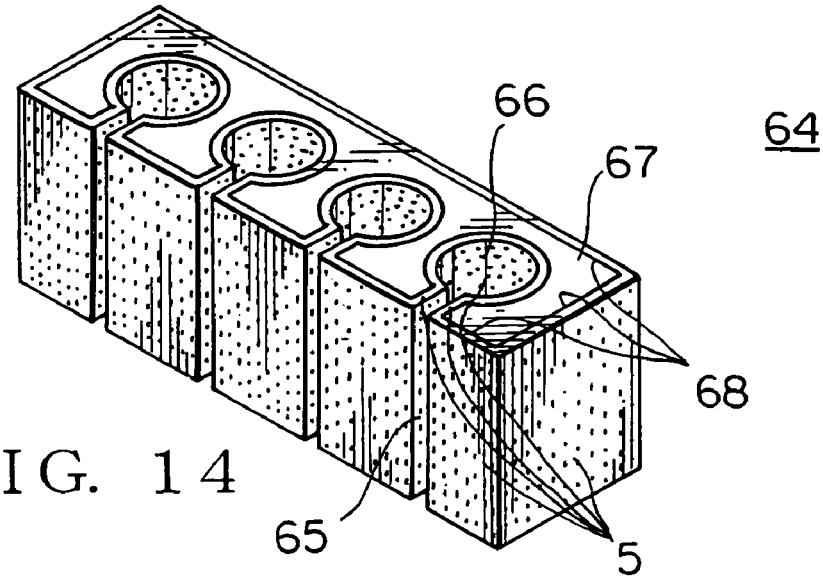
FIG. 14 is a perspective view illustrating a further preferred embodiment of a waterproof packing.

FIG. 14 shows a non-division-type waterproof packing 64, in which a round electric wire 3 is inserted into an electric wire passing hole (electric wire passing part) 66 from a slit 65. The slits 65 are arranged in a line on a long wall of a core member 67 with an equal pitch, each slit 65 communicates with the electric wire passing hole 66 situated in the middle in the thickness direction, and thermoplastic adhesive 5 is applied on an inner surface of the slit 65, inner peripheral surface of the electric wire passing hole 66 and an outer peripheral surface (contacting part) 68 of the core member 67. Preferably, the core member 67 is made of elastic material such as synthetic rubber in order to extend the slit 65 upon passing of the electric wire. Preferably, the slit 65 is almost closed initially. The waterproof packing 64 using the slit 65 can be applied to a round-shaped waterproof packing. The non-used electric wire passing hole 66 can be provided with a waterproof plug and attained waterproofing with the thermoplastic adhesive 5.

Figure 15A:
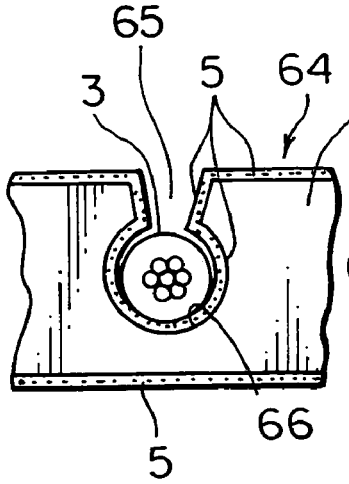
FIG. 15A is a plan view illustrating a state when an electric wire is inserted in a waterproof packing.
Figure 15B:
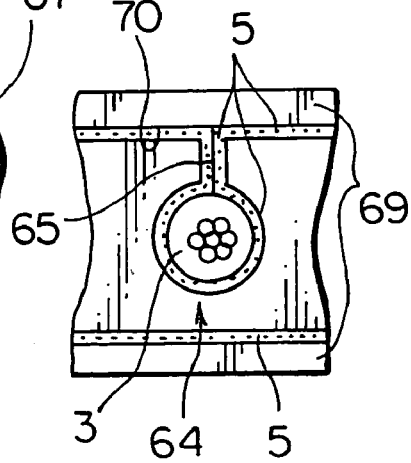
FIG. 15B is a plan view illustrating a state when a waterproof packing is inserted in a mounting side.
Figure 15C:
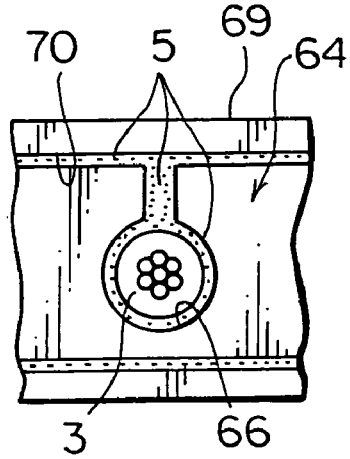
FIG. 15C is a plan view illustrating a state when waterproofing is attained with thermoplastic adhesive melted by heating.
Figure 16:
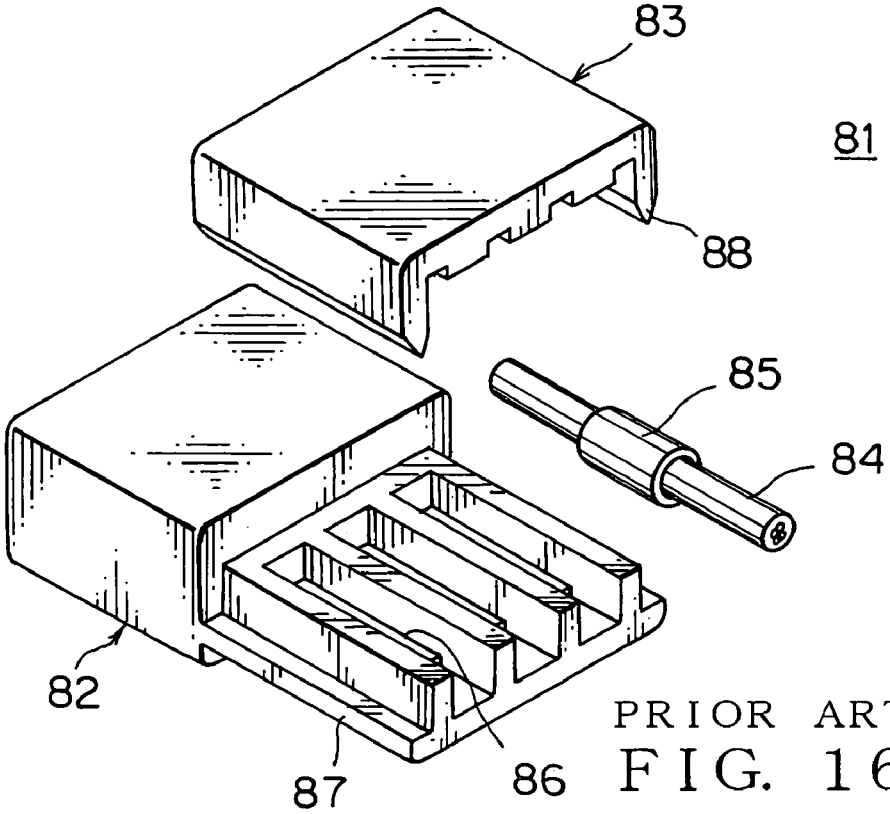
PRIOR ART FIG. 16
FIG. 16 is an exploded perspective view illustrating an example of a conventional waterproof connector.

As shown in FIG. 15A, the electric wire 3 is inserted into the electric wire passing hole 66 from the slit 65, thereafter as shown in FIG. 15B, the electric wire 3 is inserted (pressed) into a packing receiving part (mounting side) 70 having a hole-shape of a resin body 69 such as a connector housing or electric junction box body, an inner peripheral surface of the packing receiving part 70 presses the waterproof packing 64, the slit 65 opened in FIG. 15A is closed recovering to an initial shape, on this condition the waterproof packing 64 is heated, so that as shown in FIG. 15C, the thermoplastic adhesive 5 is melted to seal the slit 65, simultaneously the outer peripheral surface of the electric wire 3 adheres to the inner peripheral surface of the electric wire passing hole 66 of the core member 67 so as to attain the waterproofing therebetween, and the outer peripheral surface 68 of the core member 67 adheres to the inner peripheral surface of the packing receiving part 70 of the mounting side 69 such as a connector housing or electric junction box body so as to attain the waterproofing therebetween.

Preferably, an inner diameter of the packing receiving part 70 is such a dimension that the packing receiving part 70 comes in contact with an outer peripheral surface of the waterproof packing 64 upon the insertion of the waterproof packing 64. The waterproof packing 64 is inserted into the packing receiving part 70 being pressed with a certain force. This is also the case in the preferred embodiments described above.

In the waterproof structure using the waterproof packing 1, 1', 40, 46, 52 or 64 in the preferred embodiment described above, if the electric wire 3, 39, 51 or the terminal 23 must be taken out for the purpose of maintenance and so on or, alternatively, if the electric wire or the terminal must be separated from the connector housing 22, 28, 31 or the electric junction box body 36, on a condition that the waterproof packing is re-heated so as to melt the thermoplastic adhesive 5, the electric wire is pulled out together with the waterproof packing and then the waterproof packing can be divided or, alternatively, the electric wire is pulled so that the electric wire can be easily separated from the electric wire passing hole of the waterproof packing.

The aforementioned preferred embodiments are described to aid in understanding the present invention and variations may be made by one skilled in the art without departing from the spirit and scope of the present invention.

What is claimed is:

1. A waterproof packing comprising:

a core member including an inner electric wire passing part and an outer contacting part, having an outer peripheral surface, arranged for mounting in a packing receiving part of a connector housing; and thermoplastic adhesive adhering to at least the electric wire passing part and all around the outer peripheral surface of the contacting part, wherein the waterproof packing adheres to an electric wire with the thermoplastic adhesive of the electric wire passing part and the outer peripheral surface of the waterproof packing adheres, with no gap therebetween, to an inner surface of the packing receiving part of the connector housing with the thermoplastic adhesive of the contacting part by heating.

2. The waterproof packing according to claim 1, wherein the core member is divided from the electric wire passing part.

3. The waterproof packing according to claim 2, wherein the electricwire passing part consists of an electric wire passing hole, an electric wire passing soft surface for embedding the electric wire therein, a hollow chamber to be filled with the thermoplastic adhesive or an electric wire passing surface for passing a flat electric wire therethrough.

4. The waterproof packing according to claim 1, further comprising a slit for inserting an electric wire therethrough, wherein the slit communicates with an electric wire passing hole as the electric wire passing part and the thermoplastic adhesive adheres to the slit.

5. The waterproof packing according to claim 1, further comprising a waterproof plug mounted or formed on the electric wire passing part which is not utilized.

6. A waterproof connector comprising:

a waterproof packing according to claim 1;

a connector housing for inserting an electric wire having a terminal therein; and a packing receiving part of the connector housing, wherein the waterproof packing is inserted in the packing receiving part.

7. The waterproof connector according to claim 6, wherein the connector housing consists of: an inner housing for inserting the electric wire having a terminal therein; and an outer housing for inserting the inner housing therein, wherein the packing receiving part is formed on the outer housing.

8. A process for producing a waterproof connector comprising the steps of:

passing an electric wire through the electric wire passing part of the waterproof packing according to claim 1;

inserting the waterproof packing in a packing receiving part of a connector housing; and heating the waterproof packing to melt the thermoplastic adhesive so that the electric wire adheres to the electric wire passing part and the waterproof packing adheres to the packing receiving part with the melted thermoplastic adhesive, thereby attaining waterproofing of the waterproof connector.

* * * * *